United States Patent [19]

Winkler et al.

[11] Patent Number: 4,495,852

[45] Date of Patent: Jan. 29, 1985

[54] ARMOR CAR-MOUNTED MORTAR

[75] Inventors: Gert Winkler, Meerbusch; Wilfried Becker, Düsseldorf; Erich Zielinski, Haan, all of Fed. Rep. of Germany

[73] Assignee: Rheinmetall GmbH, Düsseldorf, Fed. Rep. of Germany

[21] Appl. No.: 385,007

[22] Filed: Jun. 3, 1982

[30] Foreign Application Priority Data

Jun. 3, 1981 [DE] Fed. Rep. of Germany ..... 3121998
Jun. 3, 1981 [DE] Fed. Rep. of Germany ..... 3121999

[51] Int. Cl.[3] ..... F41F 1/06

[52] U.S. Cl. ..... 89/46; 89/37 L; 89/40 A

[58] Field of Search ..... 89/1 F, 1 J, 37 C, 37 L, 89/38, 40 A, 46

[56] References Cited

U.S. PATENT DOCUMENTS 2,197,816 4/1940 Tate ..... 89/40 A
2,818,781 1/1958 Ruf .

FOREIGN PATENT DOCUMENTS 66757 1/1940 Czechoslovakia ..... 89/1 F
2251846 5/1973 Fed. Rep. of Germany .

*Primary Examiner*—Stephen C. Bentley
*Attorney, Agent, or Firm*—Spencer & Frank

[57] ABSTRACT

A weapons system including a mortar and a vehicle. The vehicle has a body including a side wall having a region constructed for receiving the mortar. A mounting device is connected with the vehicle for mounting the mortar for movement between a traveling position in which the mortar is positioned to travel with the vehicle and a firing position in which the mortar is positioned to fire a projectile. The traveling position is delimited by the region provided in the side wall for receiving the mortar and the firing position is located on the ground in the vicinity of the vehicle.

10 Claims, 5 Drawing Figures

ARMOR CAR-MOUNTED MORTAR

BACKGROUND OF THE INVENTION

The invention relates to a weapons system including a vehicle and a mortar attached thereto whereby the mortar is moved from a traveling position to a firing position by lowering it to the ground in the vicinity of the vehicle.

A weapons system of the above-mentioned type is disclosed in German Offenlegungsschrift No. 2,251,846. From the traveling position on board a chain-driven vehicle in which it occupies a predominant portion of the vehicle interior, a mortar can be lowered into the firing position by means of a telescopable rod assembly along a path of movement which is very slightly inclined with respect to the bottom of the vehicle. The movement from the firing position into the traveling position is effected by means of a rope pulley. It has here been found to be a drawback that the firing position is not in the immediate vicinity of the vehicle and is consequently essentially unprotected. Moreover, loading as well as putting the mortar into position is complicated and time consuming. The drawbacks resulting therefrom for use in combat are easily recognizable.

SUMMARY OF THE INVENTION

It is an object of the invention to provide a weapons system of the above-mentioned type in which the firing position is in the immediate vicinity of the vehicle and the changeover from the traveling position into the firing position and vice versa can be effected in a rapid manner.

The above and other objects are accomplished according to the invention in which a weapons system is provided that includes a mortar and a vehicle having a body provided with a side wall having a region constructed for receiving the mortar. In addition, a means connected with the vehicle is provided for mounting the mortar for movement between a traveling position in which the mortar is positioned to travel with the vehicle and a firing position in which the mortar is positioned to fire a projectile. The traveling position is delimited by the region provided in the side wall for receiving the mortar and the firing position is located on the ground in the vicinity of the vehicle.

The invention will now be explained in greater detail with the aid of two preferred embodiments which are illustrated in the drawing.

DESCRIPTION OF THE PREFERRED EMBODIMENTS

Figure 1:
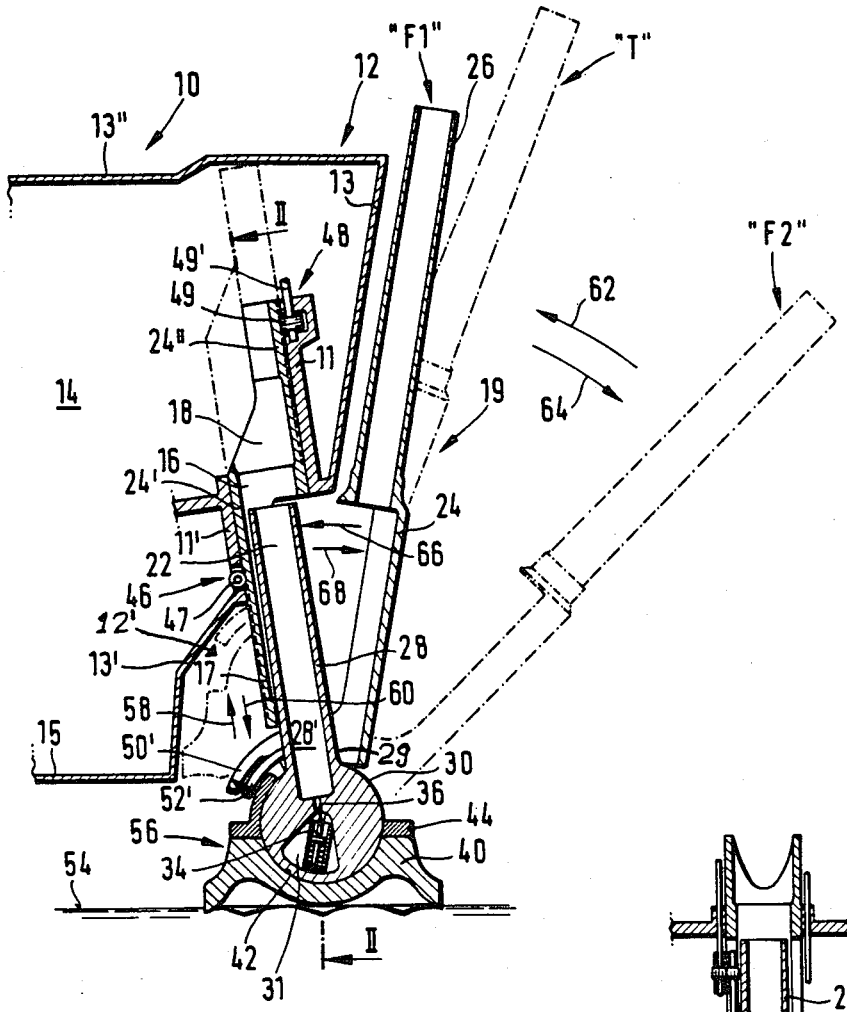
FIG. 1 is a cross-sectional view of a first embodiment according to the invention showing the tail section of the vehicle in a vertical plane along the bore axis of the mortar.
Figure 2:
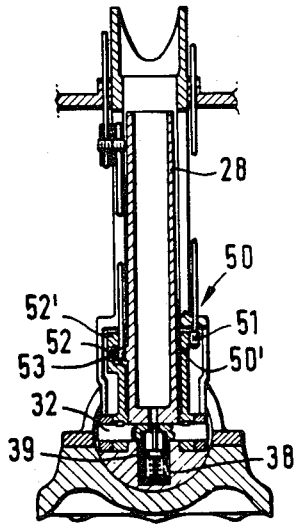
FIG. 2 is a cross-sectional view of the same embodiment along the line II—II of FIG. 1.

Referring to FIGS. 1 and 2, an armored vehicle 10 is provided at its rear with an overhang 12 which is defined on the exterior by a rear side wall 13 and at the underside by a side wall 13' which changes into the vehicle bottom 15. A recess 12' is formed which can be brought into a communicating connection with the interior 14 via an opening 16. The opening 16 is defined by a rear wall 11 and a front wall 11' parallel thereto. A track 18 in the central plane of opening 16 is slightly inclined with respect to the vehicle 10 and forms an angle around 80° with the track in the bottom surface 54. A mortar 19 having a housing 24 is provided with a two-part tube having an upper tube section 26 and a rear, lower tube section 28. The latter is arranged to be pivotal with respect to the upper tube section 26 about an axis 32. The axis 32 traverses a ball joint 30 at the rear, lower end 29 of the tube section 28. Through a cover 44, the ball joint 30 is mounted in a ball socket 42 in the bottom plate 40. In a recess 31 in the ball joint 30 there is disposed a firing pin 34 equipped with a firing pin spring 38 and a tensioning device 39 for the firing spring 38. A bore 36 provides a passage into the interior 28' of the tube for the firing pin 34. The housing 24 of the mortar 19 is provided with a first rear section 24' and a second rear section 24''. Section 24' is connected, via a toothed strip 17, with a device 46 disposed at the wall 11' for raising and lowering the mortar 19. For the sake of clarity, only the pinion 47 of this device 46 is shown. Section 24'' is connected with a traversing device 48 disposed at the wall 11, of which, for reasons of clarity, only a pinion 49 driven via 49' is shown.

The mortar 19 is shown in its traveling position in a dot-dash illustration marked with the letter "T". From this position, it can be lowered by means of device 46 in the direction of arrow 60 into the firing position in which it is shown in solid lines. The bottom plate 40 then rests on the bottom surface 54 and occupies a region 56 thereon which is at least in part covered by the overhang 12 at the tail of the vehicle 10. An elevation adjustment device 50 and its drive pinion 51 as well as a member 50' in form-locking connection therewith are shown in the region near the bottom of housing 24. At the rear end 29 of the tube section 28, a pivoting device 52 designed as a swivel breech for the tube section 28 is connected with a drive pinion 53 and with a member 52' form-lockingly connected therewith.

The mortar 19 is disposed in the firing position identified as "F". To load it, the lower tube section 28 is pivoted in the direction of arrow 66 by means of the pivoting device 52, 52' 53 operated from the interior 14 until the bore axis 22 of the tube 28 lies in the central plane 18 of opening 16. This causes the tensioning device 39 to tension the firing pin spring 38 and cock the firing pin 34. From the interior 14, a unit of ammunition (not shown) is now inserted into the tube section 28 and the latter is pivoted in the direction of arrow 68 until it is again flush with the tube section 26 and forms a gas-tight seal in a manner not to be described in detail. By actuating a firing device (not shown), shot development is initiated.

Lowering the barrel as shown, for example, at "F2" is effected via the elevation adjusting device 50, 50', 51 which is operated from the interior 14. The traversing device 48 is also operated from the interior 14 so that the operating personnel is afforded protection by the side wall 13, 13' and the upper cover 13''. By lowering the mortar into the firing position on the bottom surface 54, forces developed during firing are not introduced into the vehicle 10; consequently, the vehicle may be designed as a very light-weight vehicle. Lowering from the traveling position "T" into the firing position "F1" along a straight line over a range of 80° advantageously assures not only very quick taking of position and changing of position but also enables loading of the mortar 19 from the interior 14.

Figure 4:
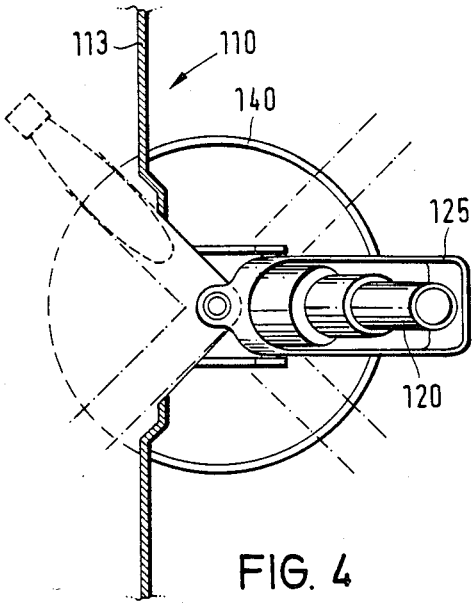
FIG. 4 is an elevational top view in partial cross-section in the direction of arrow IV of the embodiment shown in FIG. 3 with the mortar in the firing position.
Figure 5:
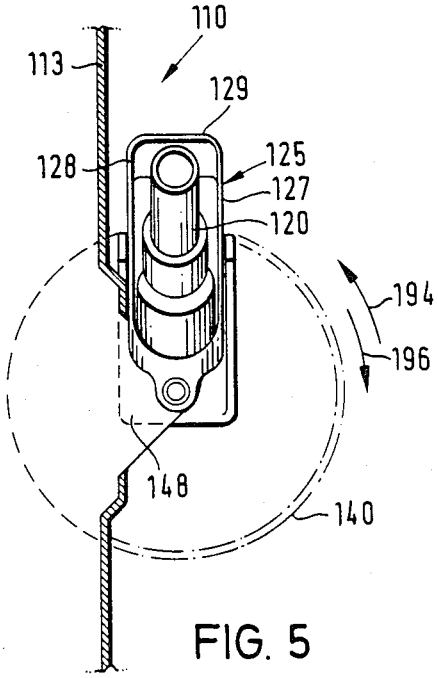
FIG. 5 is the same view as FIG. 4 with the mortar in the traveling position.

The second embodiment according to FIGS. 3, 4 and 5 will now be discussed.

The armored vehicle 110 has an overhang 112 at its tail. This overhang is delimited by a side wall 113, which at the bottom changes to the vehicle bottom 115. The interior 114 is provided with a cover 113' at the top and a rear opening 116 adjacent this top cover 113'. On the outside, an upper bearing 148 and a lower bearing 149 for a vertical holding rod 147 are provided in front of side wall 113 and below opening 116. The holding rod passes through a longitudinal bore (not shown) in the rear portion 126 of a mount 125. The mount 125 has a left arm 127 and a right arm 128 whose free ends project therefrom and are connected together by a bar 129. Along the lower, bent edges of the arms 127 and 128, circular arc shaped guides 150 are provided at the inside for cooperating with the elevation adjustment device of the mortar 119, which guides are shown in dashed lines. The mount 125, which is open at top and bottom, encases the tube 120 of the mortar 119. At the lower extremity, barrel 120 is provided with a ball joint 130 for mounting in a ball socket 142 in the bottom plate 140.

The ball joint 130 is releasably fastened in the ball socket 142. The mount 125 is pivotal in the direction of arrows 194 and 196 (FIG. 5), with the ball joint 130, in the firing position, lying in a lower extension of a vertical axis S defined by rod 147. On the bottom surface 154, the bottom plate 140 is supported in the region 156 which is at least in part covered by the rear overhang 112. A loading rocker 170 is provided with a rod assembly 172 whose lower end 174 is mounted to be pivotal about a horizontal axis 176 associated with the ball joint 130. At the upper end 178 of the rod assembly 172, an essentially circularly cylindrical projectile holder 180 is arrestably articulated at 184. The projectile holder 180 is provided with a clamping device 192 for a unit of ammunition 186.

Figure 3:
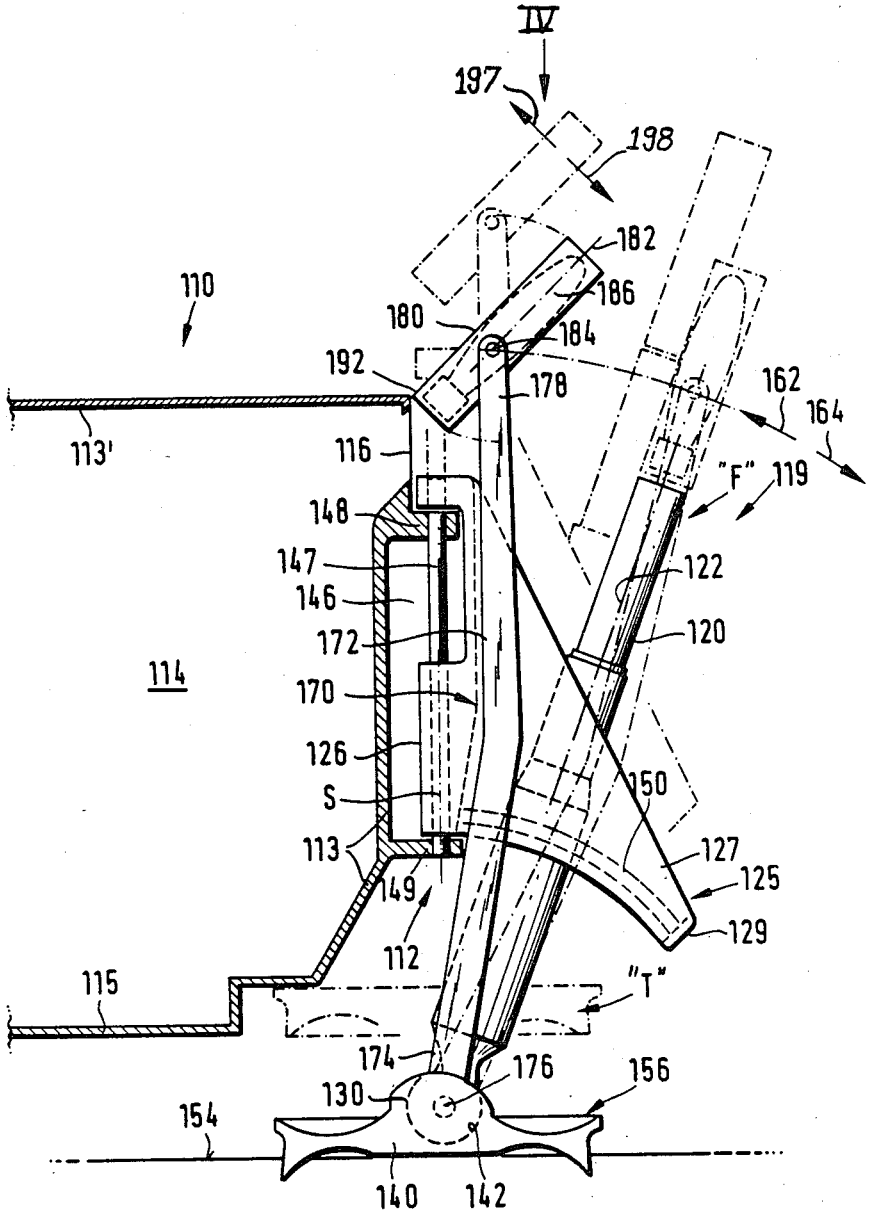
FIG. 3 is a cross-sectional view of a second embodiment according to the invention showing a tail section of the vehicle along the bore axis of a mortar.

In FIG. 3, the mortar 119 is disposed in the firing position identified by the letter "F". For loading, the loading rocker 170 is moved in the direction of arrow 162 toward the side wall 113 and the projectile holder 180 is pivoted in such a manner that a rearward extension of its axis 182 passes through opening 116. The upper end (not identified in detail) of a unit of ammunition 186 is inserted through opening 116 into the projectile holder 180 which is pivoted in the direction of arrows 197–198 and is aligned by means of rod assembly 172 with respect to tube 120 in such a manner that its axis 182 is flush with the bore axis 122. As soon as the unit of ammunition 186 has been enabled, by release of the clamping device 192, to fall into the tube 120, the loading rocker is pivoted back in the direction of arrow 162 so that the projectile holder 180 does not interfere with the unit of ammunition 186 which moves out of the tube 120 in the opposite direction. In order to realize a rapid firing rate, two loading rockers 170 are advantageously arranged in such a manner that after firing, one of them can immediately be pivoted forward in the direction of arrow 164 for renewed loading of the mortar 119. To bring the mortar 119 into the traveling position "T", it is raised along rod 147 by means which are not shown and is finally pivoted in the direction of arrow 162 against the tail wall 113 where it is fastened releasably.

We claim:

1. A weapons system comprising:

a mortar having a tube with a bore axis;

a vehicle having a body including a side wall, said sidewall having a region constructed for receiving said mortar;

means connected with said vehicle for mounting said mortar for movement between a traveling position in which said mortar is positioned to travel with said vehicle and a firing position in which said mortar is positioned to fire a projectile, said traveling position being delimited by the region provided in said side wall for receiving said mortar and said firing position being located on the ground in the vicinity of said vehicle; and a loading rocker means for loading said mortar tube with a projectile, said loading rocker means including: a rod assembly having an upper free end and a lower end with a pivot axis; means mounting said rod assembly for pivotal movement about said pivot axis between said vehicle body and said mortar tube; and a projectile holder having a longitudinal axis and being pivotally articulated at the upper free end of said rod assembly, said projectile holder including a releasable clamping unit for releasably holding a projectile in said projectile holder; wherein said rod assembly is pivotable about said pivot axis toward said vehicle into a receiving position for insertion of a projectile into said projectile holder and said rod assembly is pivotable toward said mortar tube into a discharge position in which the longitudinal axis of said projectile holder is aligned with the bore axis of said mortar tube, and in said discharge position said clamping unit is releasable for discharging the projectile into said mortar tube, whereupon said rod assembly is immediately returnable into said receiving position.

2. A weapons system according to claim 1, wherein said vehicle body includes an overhang and said side wall is disposed in the region of said overhang.

3. A weapons system according to claim 2, wherein said overhang is disposed at the rear of said vehicle.

4. A weapons system according to claim 2, and further comprising a bottom plate attached to the bottom end of said mortar tube, wherein in said firing position said bottom plate rests on the ground in a region covered at least in part by said overhang.

5. A weapons system according to claim 1, wherein said vehicle is an armored vehicle.

6. A weapons system comprising:

a mortar having a tube with a bore axis a vehicle having a body including a side wall, said side wall having a region constructed for receiving said mortar;

mounting means, connected with said vehicle and including a vertical rod mounted outside said side wall and a mounting member connected to said mortar and slidably disposed on said vertical rod, for mounting said mortar for movement between a traveling position in which said mortar is positioned to travel with said vehicle and a firing position in which said mortar is positioned to fire a projectile, said traveling position being delimited by the region provided in said side wall for receiving said mortar and said firing position being located on the ground in the vicinity of said vehicle; and a loading rocker means for loading said mortar tube with a projectile, said loading rocker means including: a rod assembly having an upper free end and a lower end with a pivot axis; means mounting said rod assembly for pivotal movement about said pivot axis between said vehicle body and said mortar tube; and a projectile holder having a longitudinal axis disposed at the upper free end of said rod assembly, said projectile holder including a releasable clamping unit for releasably holding a projectile in said projectile holder; wherein said rod assembly is pivotable about said pivot axis toward said vehicle into a receiving position for insertion of a projectile into said projectile holder and said rod assembly is pivotable toward said mortar tube into a discharge position in which the longitudinal axis of said projectile holder is aligned with the bore axis of said mortar tube, and in said discharge position said clamping unit is releasable for discharging the projectile into said mortar tube, whereupon said rod assembly is immediately returnable into said receiving position.

7. A weapons system according to claim 6, wherein said vehicle body includes an overhang and said side wall is disposed in the region of said overhang.

8. A weapons system according to claim 7, wherein said overhang is disposed at the rear of said vehicle.

9. A weapons system according to claim 7, and further comprising a bottom plate attached to the bottom end of said mortar tube, wherein in said firing position said bottom plate rests on the ground in a region covered at least in part by said overhang.

10. A weapons system according to claim 6, wherein said vehicle is an armored vehicle.

* * * * *